United States Patent [19]

Christensen et al.

[11] Patent Number: 4,981,159

[45] Date of Patent: Jan. 1, 1991

[54] HYDRAULIC CONTROL VALVE WITH PRESSURE SENSING MEANS

[75] Inventors: Thorkild Christensen, Sonderborg; Svend E. Thomsen, Nordborg, both of Denmark; Siegfried Zenker, Kirchseeon, Fed. Rep. of Germany

[73] Assignee: Danfoss A/S, Nordborg, Denmark

[21] Appl. No.: 442,447

[22] Filed: Nov. 27, 1989

Related U.S. Application Data

[63] Continuation of Ser. No. 299,122, Jan. 23, 1989, abandoned.

[30] Foreign Application Priority Data

Jan. 29, 1988 [DE] Fed. Rep. of Germany ..... 3802672

[51] Int. Cl.[5] ..... F15B 13/04

[52] U.S. Cl. ..... 137/625.69; 91/446; 137/596.13

[58] Field of Search ..... 91/446; 137/596.13, 137/625.69

[56] References Cited

U.S. PATENT DOCUMENTS 3,828,813 8/1974 Haussler ..... 137/596.13

4,649,951 3/1987 Tardy ..... 137/596.13 X 4,736,770 4/1988 Rousset et al. ..... 137/596.13 X 4,782,859 11/1988 Constantinian ..... 137/596.13 X

*Primary Examiner*—Gerald A. Michalsky

*Attorney, Agent, or Firm*—Wayne B. Easton; Clayton R. Johnson

[57] ABSTRACT

A hydraulic control valve and sensing mechanism for controlling flow between a motor and a pump and container that includes a slide mounted in a housing bore for movement between a neutral position and two operative position. The slide has a central collar separated from end collars by slide grooves, profilings on diametric opposite sides of the slide grooves intersecting each groove. The housing bore has a pump groove supplied with pressure medium, axially opposite motor grooves connectable to motor conduits, and axially opposite the motor grooves from the pump grooves there are container grooves connectable to the container. The pressure sensing mechanism includes at least one pressure sensing orifice that is connected to the pressure to be sensed in an operative position of the slide but not being fluidly connected thereto when the slide is in its neutral position.

11 Claims, 2 Drawing Sheets

HYDRAULIC CONTROL VALVE WITH PRESSURE SENSING MEANS

RELATED APPLICATION

Figure 1:
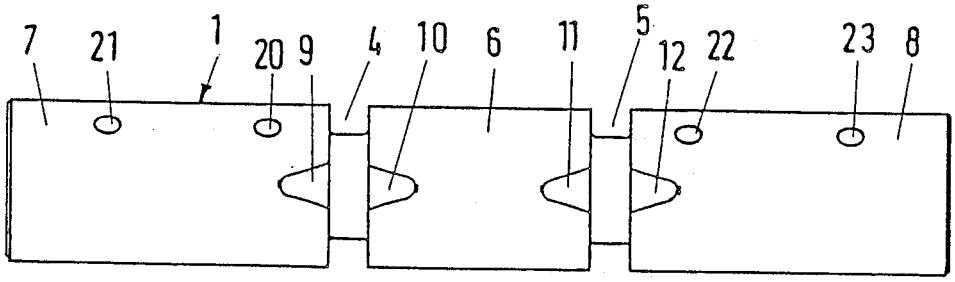

This application is a continuation application of Ser. No. 07/299,122, filed Jan. 23, 1989, now abandoned.

The invention relates to a hydraulic control valve with pressure sensing means, wherein a slide is disposed in a housing bore and is movable out of a neutral position into two operative positions, the slide has a central collar and two end collars separated therefrom by a respective annular slide groove, the collars have throttle profilings at the confronting sides, the housing bore has an annular pump groove which is supplied with pressure medium and to both sides of which there is a respective annular motor groove connectable to a motor conduit and, to both sides beyond same, a respective annular container groove connectable to the container, and wherein the pressure sensing means comprise at least one pressure sensing orifice which is connected to the conduit at the pressure to be sensed in the operative position of the slide but separated therefrom in the neutral position.

Such a control valve is known from DE-AS 16 50 312, which corresponds to U.S. Pat. No. 3,488,953. Since there are only two annular slide grooves, the construction is simple and there is a good seal for the slide at both end collars. The throttle profiling consists of conical bevelling which permits the throttle resistance to decrease gradually depending on the amount of displacement of the slide out of the neutral position. Two pressure sensing orifices are disposed to both sides of the annular pump groove in the housing bore for the purpose of detecting the load pressure at the outlet of the control valve at the side of the motor. The construction requires that, upon displacement of the slide out of the neutral position, the throttle profiling comes into communication with the pressure sensing orifice after a first distance and with the annular pump groove after a second distance. This results in a correspondingly large dead play until the control valve responds. In addition, the detected pressure is indefinite near the neutral position.

A control valve is also known U.S. Pat. No. 3,828,813 (DE-OS 23 04 334), in which the slide comprises a total of five annular grooves and consequently a correspondingly long length. Extending from the base from the second and fourth annular slide grooves which are each associated with a motor conduit, there is a diametral bore which is connected by a connecting passage in the slide to an outlet aperture at the circumference of one of the end collars. This outlet aperture communicates at least in the operative position of the slide with an annular sensing pressure groove disposed near the end of the housing bore. The pressure sensing orifices always remain connected to a motor conduit. The outlet apertures, however, are covered by the housing bore in the neutral position.

It is also known (Bosch Control Valve SB12LS) to provide a slide with five annular slide grooves and to restrict the throttle profilings to circumferential sections. This gives a fine control range near the neutral position.

The invention is based on the problem of providing a hydraulic control valve of the aforementioned kind which permits greater freedom in the arrangement of the pressure sensing orifice and in particular facilitates smaller dead play of the slide between the neutral position and the operative position.

This problem is solved according to the invention in that the throttle profilings are confined to circumferential sections and that the at least one pressure sensing orifice is disposed at the slide circumference circumferentially offset from the throttle profilings and connected to a pressure sensing connection by way of a connecting passage in the slide.

In this construction, the pressure sensing orifices as well as the throttle profilings are disposed at the surface of the slide. They therefore have a fixed relationship to each other. Since they are offset circumferentially, they can have a much smaller axial spacing than hitherto. This is because for sealing purposes it is sufficient if the circumferential section between them is covered by part of the housing bore whilst the connection is produced by the respective annular groove in the housing bore. A smaller axial spacing also results in less dead play. In addition, a slide with pressure sensing orifices is obtained with an extremely short length.

In particular, the throttle profilings may be formed by axial grooves which increase in cross-section towards the annular slide groove. Above all, the axial grooves may increase in depth and width towards the annular slide groove. In this way, the desired throttle cross-section is obtained with a very short circumferential extent.

Preferably, every two identical throttle profilings are diametrally opposed at the circumference of the slide. This results in hydraulic equilibrium during operation.

It is favourable for the at least one pressure sensing orifice to be disposed at the height of the flat end of the throttle profiling. The cross-section of the pressure sensing orifice may even partially axially overlap the throttle profiling. This results in short or extremely short dead play.

It is recommended that the connecting passage should lead to an outlet aperture which is disposed at the circumference of the end collars and which, at least in the operative position of the slide, communicates with one of two annular pressure sensing grooves disposed in the housing bore axially beyond the annular container grooves. This permits a simple connection to a pressure sensing connection fixed with respect to the housing and closure of the connecting passage if this is necessary.

Advantageously, the connecting passage has an axial bore which extends from the end of the slide and is connected by a respective radial bore to a pressure sensing orifice and an outlet aperture. Such a construction is easy to bring about.

Desirably, the two ends of a diametral bore form two pressure sensing orifices. The diametral bore is easy to produce. In addition, hydraulic equilibrium is obtained.

In one embodiment, the pressure sensing orifice is disposed in one end collar to determine the load pressure in an annular motor groove. By displacement towards the annular pump groove, the pressure sensing orifice comes into communication with the annular motor groove whilst the latter is at the same time connected to the annular pump groove by way of a throttle profiling.

In addition, it is possible for the pressure sensing orifice to be in communication with an annular container groove in the neutral position. The container pressure may therefore obtain in the pressure sensing system in the neutral position.

In an alternative construction, the pressure sensing orifice is disposed in the central collar to determine the inlet pressure in the annular pump groove. In the neutral position, it is covered by bore sections but on commencement of the operative position it comes into communication with the annular pump groove together with the adjacent throttle profiling.

In this connection, it is recommended that a fixed throttle be provided in the connecting passage and a variable throttle depending on the slide position at the outside of the slide between the annular sensing pressure groove and the annular container groove. In this way one obtains a series circuit of two throttles between the annular pump groove and the annular container groove. The pressure obtaining in the annular pressure sensing groove depends on the ratio of the throttle resistances and thus on the slide position.

Existing bores may be used as the fixed throttle if their cross-section is appropriately dimensioned. The variable throttle preferably comprises an axially extending throttle groove which is circumferentially offset from the outlet aperture and has a cross-section decreasing towards the end of the slide. This throttle cross-section can be very accurately selected so that the characteristic pressure curve accurately reproduces the slide position.

Advantageously, in the neutral position at the axially outer end of the annular sensing pressure groove the outlet aperture is in communication therewith. This outlet aperture moves towards the free end of the housing bore only when it is at the load pressure of the delivery side. Sealing problems can therefore not arise. It is possible for the outlet aperture to be in communication with the annular sensing pressure groove in the neutral position.

Figure 2:
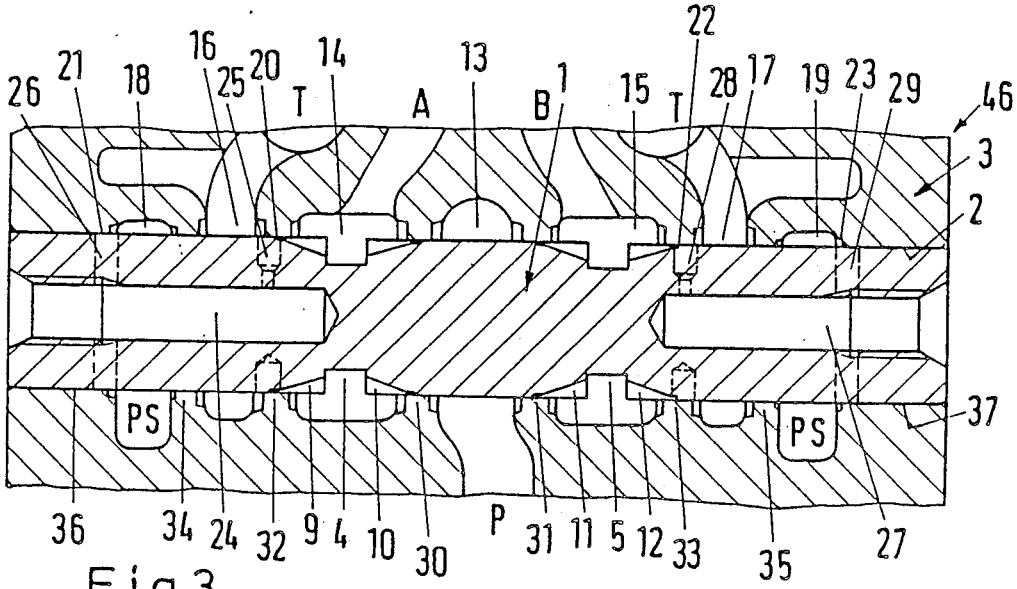
Figure 3:
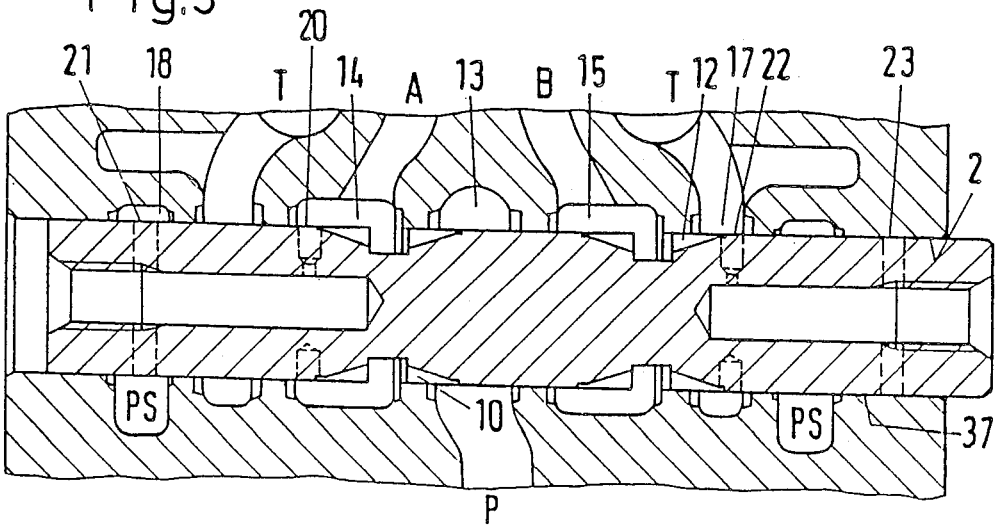
Figure 4:
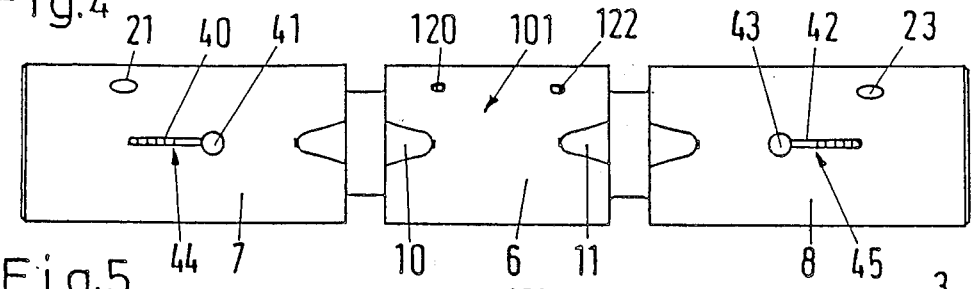
Figure 5:
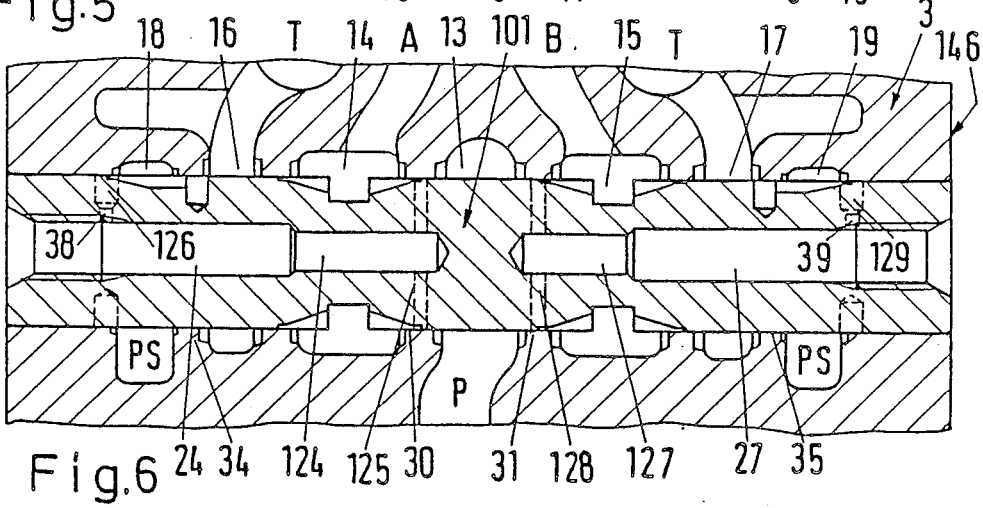
Figure 6:
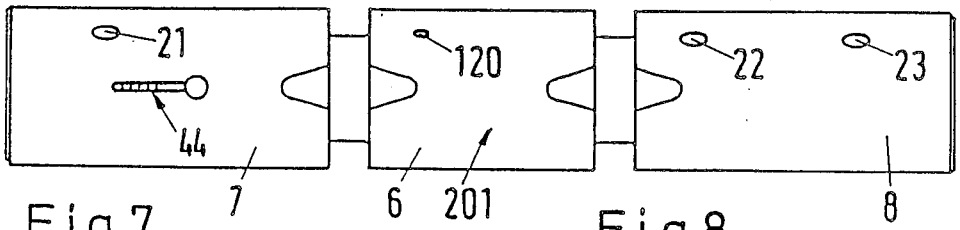
Figure 7:
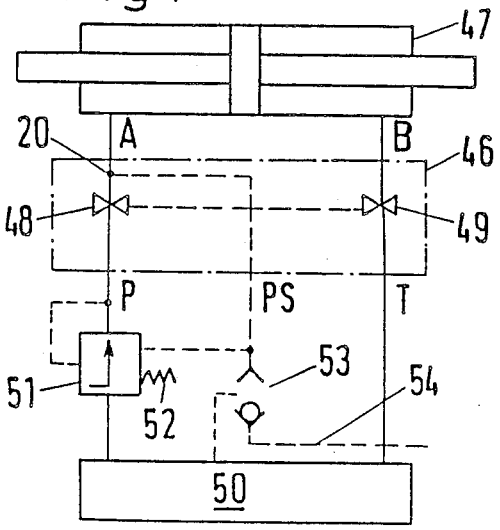

The invention will now be described in more detail with reference to preferred examples illustrated in the drawing wherein:

FIG. 1 is a plan view of a slide of a first embodiment of a control valve according to the invention, FIG. 2 is a longitudinal section through this control valve, the slide being in the neutral position, FIG. 3 is a longitudinal section as in FIG. 2 but with the slide in an operative position, FIG. 4 shows the slide of a second embodiment of control valve according to the invention, FIG. 5 is a longitudinal section through the FIG. 4 control valve, the slide being in the neutral position, FIG. 6 is a plan view of the slide of a third embodiment of control valve according to the invention, FIG. 7 is a circuit diagram of a hydraulic installation with the control valve of FIGS. 1 to 3, FIG. 8 is a circuit diagram of a hydraulic installation with the control valve of FIGS. 4 and 5.

The control valve 46 of FIGS. 1 to 3 comprises a slide 1 which is displaceable in the bore 2 of a housing 3 out of the neutral position shown in FIG. 2 into the operative position of FIG. 3 or an operative position symmetrical therewith. The slide 1 comprises two annular slide grooves 4 and 5 between which there is a central collar 6. To both sides outside the annular slide grooves 4 and 5 there is a respective end collar 7 and 8. The collars 6, 7 and 8 are cylindrical but have throttle profilings 9, 10, 11 and 12 at their confronting ends. The profilings are provided in pairs at diametrally opposed sides of the slide 1. They have the form of an axial groove of which the depth and width increases towards the annular slide groove 4 or 5.

The housing bore 2 has at the middle an annular pump groove 13 which can be fed with pressure medium from an outlet P. To both sides there is a respective annular motor groove 14 and 15 connected to motor connections A and B. To both sides outside same, there is a respective annular container groove 16 or 17 and these communicate with a container connection T. Still further outwardly, there are two annular sensing pressure grooves 18 and 19 connected to a pressure sensing connection PS.

At the left hand end collar 7, a pressure sensing orifice 20 is provided at each of opposite sides and it communicates with two opposed outlet apertures 21 by way of a connecting passage in the interior of the slide 1. Correspondingly, in the right hand end collar 8 a pressure sensing orifice 22 is connected to an outlet aperture 23 by way of a connecting passage in the slide. Part of the connecting passage in the left hand end collar 7 is an axial bore 24 which extends from the end of the slide 1 and is closable at this side, a radial bore 25 extending to the pressure sensing orifice 20, and a radial bore 26 leading to the outlet aperture 21. Similarly, the right hand end collar contains a connecting passage comprising an axial bore 27, a radial bore 28 and a radial bore 29. The radial bores are not disposed in the plane of the section and are therefore only shown in broken lines. As indicated, they can also be provided on opposite sides. The pressure sensing orifices 20 and 22 are so arranged that their cross-section partially overlaps the throttle profilings 9 or 12 axially.

In the neutral position, the throttle profilings 10 and 11 terminate within a web 30 or 31 between the annular pump space 13 and one of the annular motor spaces 14 or 15 so that an efficient seal is produced. Similarly, the throttle profilings 9 and 12 terminate within a web 32 or 33 between the annular motor space 14 and the annular container space 16 or annular motor space 15 and annular container space 17. The pressure sensing orifices 20, 22 extend into the annular container space 16, 17. The webs 34 and 35 between the annular container grooves and the annular pressure sensing grooves 18 outside same merely have a sealing function. The outlet apertures 21 and 23 are so placed that their cross-section partially corresponds to the annular sensing pressure groove 18 or 19 and is partially covered by the end section 36 or 37 of the housing bore 2. Consequently, container pressure obtains at the pressure sensing connections PS.

If the slide 1 is pushed to the right into the operative position of FIG. 3, the annular pump space 13 communicates with the annular motor space 14 by way of the throttle profiling 10 and at the same time the pressure sensing orifice 20 is pushed into this annular space 14. Similarly, the outlet aperture 21 is moved further into the annular sensing pressure groove 18. The pressure sensing connection PS is therefore at the load pressure of the motor connection A. At the same time, the annular motor space 15 has been connected to the annular container space 17 by way of the throttle profiling 12. However the pressure sensing orifice 22 located at this position is ineffective because the associated outlet aperture 23 is covered by the section 37 of the housing bores. Small spacings from the end of the housing bore 2 are sufficient because the outlet aperture 23 is only at the low discharge pressure.

With this construction, there is practically no dead play. This is because at the instant when the throttle profiling 10 comes into communication with the annular pump space 13, the pressure sensing orifice 20 also comes into communication with the annular motor space 14. The ineffective initial movement is therefore reduced to the absolutely necessary spacing required for sealing between the throttle profiling 10 or 11 and the annular pump space 13.

In the control valve 146 of FIGS. 4 and 5, the valve housing 3 is completely unchanged and the slide is substantially unchanged. The same parts are therefore given the same reference numerals and corresponding parts are given reference numerals increased by 100. In this case the pressure sensing orifices 120 and 122 are provided in the central collar 6 in such a way that their cross-section partially overlaps axially with the throttle profilings 10 or 11. These pressure sensing orifices lie within the web 30 and 31 in the neutral position.

They are formed by the mouths of a diametral bore 125 or 128 which intersects an extension 124 or 127 of the axial bore 24 or 27. The bore 126 leading to the outlet aperture 21 has a fixed throttle 38 formed by a constriction in the cross-section and the bore 129 leading to the outlet aperture 23 has a throttle 39. Offset circumferentially from the outlet aperture 21 there is an axial groove 40 which terminates in a blind hole 41 and has a cross-section decreasing towards the end of the slide. Similarly, there is an axial groove 42 offset from the outlet aperture 23 terminating in a blind hole 43. The blind holes 41 and 43 are partially covered in the neutral position by the webs 34 or 35 but communicate with the annular container grooves 16 or 17.

If the slide 101 is displaced to the right into its operative position, there is a series circuit between the annular pump groove 13 and the annular container groove 16. In this series connection there is a fixed throttle 38 and a variable throttle 44 which is formed by the covered part of the axial groove 40. A pressure can be derived from between the throttles by way of the pressure sensing connection PS and it depends on the position of the slide 101. Upon adjustment in the opposite direction, there is a series circuit of a fixed throttle 39 and a variable throttle 45 on the other side of the slide.

As will hereinafter be explained in conjunction with FIGS. 7 and 8, the FIGS. 1 to 3 embodiment provides a flow control and the FIGS. 4 and 5 embodiment a pressure control, each having its own particular advantages and being used at will. Production will be considerably simplified because the valve housing 3 remains unchanged and the slide 1 requires only slightly different machining. To arrive at the slide 101 from the slide 1, it is only necessary to extend the axial bores and to replace the bores 25 with the bores 125. In addition, the throttles 38, 39 and 44, 45 have to be applied.

As is shown in FIG. 6, a slide 201 can also be constructed so that for the one operating direction it brings about a flow control and for the other operating direction a pressure control. In this case, a pressure sensing orifice 120 is provided in the central collar 6, an outlet aperture 21 and a throttle 44 in the left hand end collar 7, and a pressure sensing orifice 22 and outlet aperture 23 in the right hand end collar 8.

FIG. 7 shows how a control valve 46 according to FIGS. 1 to 3 is moved to its one operative position for a motor 47. The throttle 48 in the supply corresponds to the throttle profiling 10 and the throttle 49 in the return corresponds to the throttle profiling 12. A pressure supply 50 provides pressure medium by way of a compensating valve 51 to the inlet P of the control valve 46. This compensating valve 51 is on the one side under the influence of the inlet pressure of the control valve 46 and on the other side under the pressure at the motor connection A derived at the pressure sensing orifice 20 and under a spring 52.

The compensating valve 51 therefore keeps the pressure drop at the throttle 48 constant so that a predetermined through-flow quantity is obtained for a particular position of the slide. A change-over valve 53 which can be supplied through a conduit 54 with the sensing pressure of further consumers permits the pressure supply 50 to be operated depending on the highest load pressure.

Figure 8:
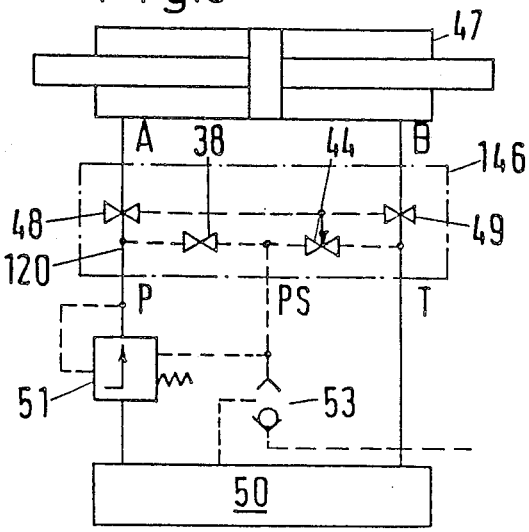

In the pressure control according to FIG. 8, a control valve 146 is used corresponding to that of FIGS. 4 and 5. The main difference is that a series circuit consisting of the fixed throttle 38 and the variable throttle 44 leads from the pressure sensing point 120 to the container connection T. The connection PS forms a tapping at which a pressure occurs depending on the slide position and this is supplied to the compensating valve 51 and the pressure supply 50.

Altogether, one obtains a control valve with a very compact slide which is also easy to machine and has low leakage loosen. In addition, there is little dead play. The fixed throttle 38, 39 can also be obtained by dimensioning the cross-section of the bores 125, 128. If the radial bores 25, 26 or 126, 129 are provided on only one side, the opposite side may, as is shown, be provided with a blind hole for the purpose of hydraulic equilibrium.

We claim:

1. A hydraulic control valve and means for sensing pressure for controlling flow of oil between a container and pump and a motor, comprising a housing having wall means defining an axially elongated housing bore, an axially elongated slide axially slidable between a neutral first position, an operative second position axially offset in one direction from the neutral position and an operative third position axially offset from the neutral position in an axially opposite direction from the one direction, the slide having an axial central collar and axially opposite first and second end collars, and first and second annular slide grooves separating the first end and second collars respectively from the central collar, the central and first collars having second and first circumferential throttle profilings respectively intersecting the first slide groove and the second and central collars having third and fourth circumferential throttle profilings intersecting the second slide groove, the collars having circumferential surfaces intersected by the profilings and the respective slide groove, the housing having an annular pump groove adapted for connection to a pump to receive pressurized oil, first and second motor grooves on axial opposite sides of the pump groove and adapted for connection to the motor, first and second annular container grooves on axial opposite sides of the pump groove that are adapted for connection to a container and pressure sensing connections that include pressure sensing third and fourth annular grooves located on axially opposite sides of the container grooves from the pump groove, the wall means including means for forming a fluid seal with the slide axially between the first and second slide grooves and on axially opposite sides of the pump groove and between the motor grooves and with the first and second collars between the first and second slide grooves and axially between the container grooves and motor grooves respectively, and with the first and second collars axially between the container grooves and the pressure sensing grooves respectively when the slide is in its neutral position, the central collar having a first pressure sensing orifice circumferentially offset from its throttle profilings that opens to the means forming a fluid seal between the pump groove and one of the motor grooves when the slide is in its neutral position and to sense the inlet pressure in the pump groove when the slide is in one of its second and third positions, the slide having a connection passage for transmitting oil pressure from the sensing orifice to one of the pressure sensing connections when the slide is in said one of its second and third positions for determining the inlet pressure in the pump groove, the slide in its second position having the second profiling opening to the pump groove to have fluid flow axially radially between the wall means and the second profiling for fluidly connecting the pump groove through the first slide groove to the first motor groove, in its third position fluidly connecting the pump groove through the second slide groove to the second motor groove and when in its neutral position block fluid flow from the pump groove to either of the motor grooves.

2. The apparatus of claim 1 characterized in that the connecting passage includes a fixed throttle that opens to the said one of the pressure sensing connections when the slide is in its neutral position, and that the slide has a variable throttle opening through the first collar circumferential surface and opens to the said one pressure sensing connection and the adjacent container groove when the slide is in its neutral position, the throttles being located relative, to one another and the grooves to provide a series circuit between the adjacent container groove and the pump groove when the slide is in its second position.

3. The apparatus of claim 2, characterized in that the fixed throttle includes an outlet aperture opening through the first collar circumferential surface and that the variable throttle comprises an axially elongated throttle groove that is circumferentially offset from the outlet aperture and of a reduced cross section in a direction axially away from the central collar.

4. The apparatus of claim 2, characterized in that the connecting passage comprises an axial elongated bore, a radial bore fluidly connecting the pressure sensing orifice to the axial bore, and an outlet aperture opening to the axial bore and through the circumferential surface to the axial bore in axially offset relationship from the pressure sensing bore.

5. The apparatus of claim 4, characterized in that the first pressure sensing orifice is axially between the first motor groove and the pump groove when the slide is in its neutral position, the central collar having a second pressure sensing orifice that when the slide is in its neutral position opens to the wall means axially between the pump groove and the second motor groove, and that the slide has a second passage that fluidly connects the second pressure sensing orifice to the fourth groove when the slide is in its third position, the first passage opening to the first pressure connection when the slide is in its second position.

6. The apparatus of claim 5 characterized in that the outlet aperture includes a fixed throttle that opens to the third groove when the slide is in its neutral position, and that the slide has a variable throttle opening through the first collar circumferential surface and opens to the third groove and the adjacent container groove when the slide is in its neutral position, the throttles being located relative to one another and the grooves to provide a series circuit between the adjacent container groove and the pump groove when the slide is in one of its second and third positions.

7. The apparatus of claim 6, characterized in that the outlet aperture opens through the first collar circumferential surface and that the variable throttle comprises an axially elongated throttle groove that is circumferentially offset from the outlet aperture and of a reduced cross section in a direction axially away from the central collar.

8. The apparatus of claim 4, characterized in that the pressure connections include a first and a second pressure connection, the second pressure connection being axially opposite of the pump groove from the first pressure connection, the first pressure sensing orifice being axially between the first motor groove and the pump groove when the slide is in its neutral position, the second collar having a second pressure sensing orifice that when the slide is in its neutral position opens to the wall means axially between the second container groove and the second motor groove, and that the slide has a second passage that fluidly connects the second pressure sensing orifice to the second pressure connection when the slide is in its third position, the first passage opening to the first pressure connection when the slide is in its second position.

9. The apparatus of claim 8 characterized in that the outlet aperture includes a fixed throttle that opens to the first pressure sensing connection when the slide is in its neutral position, and that the slide has a variable throttle opening through the first collar circumferential surface and opens to the first pressure sensing connection and the adjacent container groove when the slide is in its neutral position, the throttles being located relative, to one another and the grooves to provide a series circuit between the adjacent container groove and the pump groove.

10. The apparatus of claim 9, characterized in that the outlet aperture opens through the first collar circumferential surface and that the variable throttle comprises an axially elongated throttle groove that is circumferentially offset from the outlet aperture and of a reduced cross section in a direction axially away from the central collar.

11. A hydraulic control valve and means for sensing pressure for controlling flow of oil between a container and pump and a motor, comprising a housing having wall means defining an axially elongated housing bore, an axially elongated slide axially slidable between a neutral first position, an operative second position axially offset in one direction from the neutral position and an operative third position axially offset from the neutral position in an axially opposite direction from the one direction, the slide having an axial central collar and axially opposite first and second end collars, and first and second annular slide grooves separating the first end and second collars respectively from the central collar, the central and first collars having second and first circumferential throttle profilings respectively intersecting the first slide groove and the second and central collars having third and fourth circumferential throttle profilings intersecting the second slide groove, the collars having circumferential surfaces intersected by the profilings and the respective slide groove, the housing having an annular pump groove adapted for connection to a pump to receive pressurized oil, first and second motor grooves on axial opposite sides of the pump groove and adapted for connection to the motor, first and second annular container grooves on axial opposite sides of the pump groove that are adapted for connection to a container and pressure sensing connections that include pressure sensing third and fourth annular grooves located on axially opposite sides of the container grooves from the pump groove, the wall means including means for forming a fluid seal with the slide axially between the first and second slide grooves and on axially opposite sides of the pump groove and between the motor grooves and with the first and second collars between the first and second slide grooves and axially between the container grooves and motor grooves respectively, and with the first and second collars axially between the container grooves and the pressure sensing grooves respectively when the slide is in its neutral position, at least the first collar having a first pressure sensing orifice circumferentially offset from its throttle profiling, an outlet aperture axially offset from the pressure sensing orifice and a connecting passage for fluidly connecting the pressure sensing orifice to the outlet aperture, the pressure sensing orifice and outlet aperture at least partially opening to the pressure sensing third groove and the first container groove respectively when the slide is in its neutral position, the slide in its second position having the second profiling opening to the pump groove to have fluid flow axially radially between the wall means and the second profiling for fluidly connecting the pump groove through the first slide groove to the first motor groove, in its third position fluidly connecting the pump groove through the second slide groove to the second motor groove and when in its neutral position block fluid flow from the pump groove to either of the motor grooves, the central collar having a pressure sensing orifice to determine the inlet pressure in the pump groove when the slide is in one of its first and second positions.

* * * * *